United States Patent [19]

Rombough

[11] Patent Number: 4,782,433

[45] Date of Patent: Nov. 1, 1988

[54] FLASHLIGHT ATTACHMENT AND METHODS OF CONSTRUCTING AND UTILIZING SAME

[76] Inventor: John G. Rombough, 4591 W. Overlook Dr., Williamsville, N.Y. 14221

[21] Appl. No.: 61,815

[22] Filed: Aug. 12, 1987

[51] Int. Cl.[4] ..... F21L 7/00

[52] U.S. Cl. ..... 362/186; 362/186

[58] Field of Search ..... 362/186, 202

[56] References Cited

U.S. PATENT DOCUMENTS

| | | | |
|---|---|---|---|
| 1,916,472 | 7/1933 | Ferris et al. | 362/186 |
| 2,371,775 | 3/1945 | Pope | 362/186 |
| 2,530,069 | 11/1950 | Moore | 362/186 |
| 2,647,254 | 7/1953 | Brunnhoelzl | 362/186 |
| 2,681,979 | 6/1954 | Manoloff | 362/186 |
| 2,823,300 | 2/1958 | Graubner | 362/186 |
| 3,114,143 | 12/1963 | Robinson | 362/186 |
| 4,208,701 | 6/1980 | Schock | 362/202 |
| 4,231,077 | 10/1980 | Joyce et al. | 362/202 |
| 4,697,228 | 9/1987 | Mui et al. | 362/352 |

FOREIGN PATENT DOCUMENTS

| | | | |
|---|---|---|---|
| 2166860 | 5/1986 | United Kingdom | 362/202 |

*Primary Examiner*—E. Rollins Cross

*Attorney, Agent, or Firm*—Irving M. Weiner; Joseph P. Carrier; Roland W. Norris

[57] ABSTRACT

A wand attachment for flashlights comprises a hollow, elongated body member having an opening at a lower end thereof, and a bushing member detachably fitted in the opening at the lower end of the body member. The bushing member has a central opening defined therein, the central opening being sized so that side surfaces thereof engage an upper, light-emanating end of a flashlight. The body member includes a first annular lip formed on an inner surface of the lower end thereof and the bushing member includes a second annular lip formed on an outer surface thereof, the first and second annular lips securely engage each other when the bushing member is fitted in the body member.

12 Claims, 1 Drawing Sheet

FLASHLIGHT ATTACHMENT AND METHODS OF CONSTRUCTING AND UTILIZING SAME

BACKGROUND OF THE INVENTION

1. Field of the Invention

The present invention pertains to a wand attachment for flashlights. More particularly, the present invention pertains to a fluorescent attachment member which is connected to the light emanating end of a flashlight, the combination of the flashlight and the wand attachment functioning as a warning/signaling device.

2. Description of the Relevant Art

There are known wand attachment members for flashlights. However, none of the known wand attachment members include the novel features of the present wand attachment, as discussed and claimed hereinbelow.

SUMMARY OF THE INVENTION

According to the present invention, there is provided a wand attachment for flashlights comprising a hollow, elongated body member having an opening at a lower end thereof, and a bushing member detachably fitted in the opening at the lower end of the body member. The body member has a first annular lip formed on an inner surface of the lower end thereof and the bushing member has a second annular lip formed on an outer surface thereof, the first and second annular lips securely engaging each other when the bushing member is fitted in the body member. Also, the bushing member has a central opening defined therein, the central opening being sized such that side surfaces thereof securely engage an upper, light-emanating end of a flashlight.

It is an object of the present invention to provide a simple wand attachment for flashlights which is constructed entirely of moldable polymeric materials, and which does not require any tools for assembly thereof or for attachment to a flashlight.

It is another object of the present invention to provide a wand attachment that can be used with different sized flashlights by simply selecting a bushing member having an appropriately sized central opening.

It is a further object of the present invention to provide a wand attachment for flashlights which can also serve as a compact storage container for the flashlights when not in use.

Other objects, advantages and salient features of the present invention will become apparent from the following detailed description, which, when taken into conjunction with the annexed drawings, discloses a preferred embodiment of the present invention.

DETAILED DESCRIPTION OF THE PREFERRED EMBODIMENTS

Figure 1:
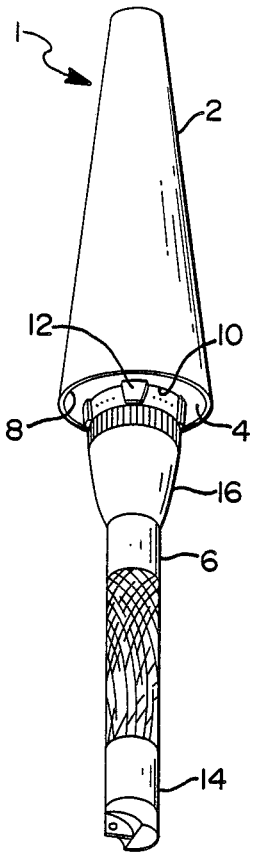
FIG. 1 is a perspective view of a wand attachment according to the present invention, as the attachment is connected to a flashlight for use as a warning/signaling device.

Referring to FIG. 1, there is shown a wand attachment, generally indicated at 1, as the attachment is connected to a flashlight 6 for use as a warning/signaling device. The wand attachment 1 includes a hollow, elongated body member 2 and a bushing member 4 which is detachably fitted in an opening 8 formed in the lower end of the body member 2. The body member 2 and the bushing member 4 are both preferably formed from a moldable plastic, for the sake of cost and convenience, and the plastic will preferably have a fluorescent pigment therein for enhanced visibility of the warning/signaling device at night. The body member 2 will preferably be conically shaped so that it can be readily used to indicate direction.

The bushing member 4 is easily connected to the body member 2 by being simply inserted into the opening 8 at the lower end of the body member. The bushing member 4 has a central opening 10 defined therein, the opening 10 being sized such that side surfaces thereof engage the upper, light-emanating end of the flashlight 6. Optionally, the bushing member 4 will include a plurality of finger members 12 depending downwardly from a lower surface thereof, which fingers are spaced equiangularly around the central opening 10 and cooperate with the central opening to detachably engage the upper end of the flashlight 6. Finger members 12 are also useful in guiding the upper end of the flashlight 6 into the central opening 10.

Because of its two-piece construction, the wand attachment 1 can be used with various sized flashlights by simply selecting a bushing member 4 having an appropriately sized central opening 10 therein.

Figure 2:
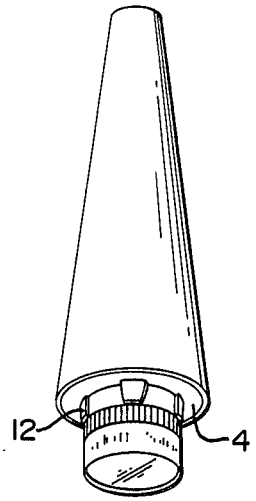
FIG. 2 is a perspective view of the wand attachment shown in FIG. 1, but with the handle of the flashlight inserted into the attachment for storage purposes.
Figure 3:
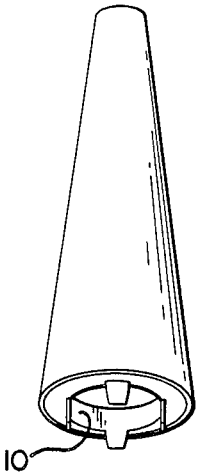
FIG. 3 is a perspective view of the wand attachment shown in FIG. 1, but without the flashlight connected thereto.

Referring to FIG. 2, the flashlight 6 is shown having its handle 14 inserted inside of the hollow body member 2. The flashlight 6 would be so positioned during non use so that the overall warning/signaling device is relatively compact and can be easily stored, such as in a pocket or purse. This is particularly true when the flashlight is a miniature flashlight. The upper end of the flashlight 6 will preferably have a tapered neck 16 to facilitate insertion of the handle 14 into the hollow body member 2.

Figure 5:
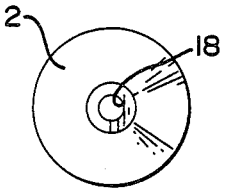
FIG. 5 is a top plan view of the wand attachment shown in FIG. 1.

Referring to FIG. 5, the hollow body member 2 also has a small opening 18 formed in an upper end thereof. This small opening permits a small portion of light to pass through the body member 2 unobstructed. This small portion of light can be used for reading, identification, etc. and eliminates the need for removing the wand attachment 1 from the flashlight 6 each time a beam of unobstructed light is desired.

Figure 7:
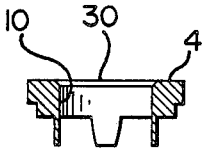
FIG. 7 is a side sectional view of the bushing member shown in FIG. 4.
Figure 4:
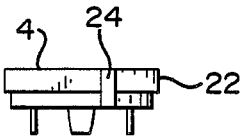
FIG. 4 is a side elevational view of a bushing member of the wand attachment shown in FIG. 1.
Figure 6:
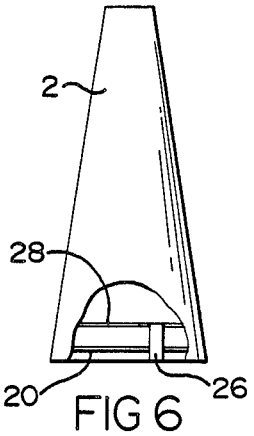
FIG. 6 is a side elevational view, partly in section, of the wand attachment shown in FIG. 3.

Referring to FIGS. 4, 6 and 7, there are shown particular preferred features of the hollow body member 2 and the bushing member 4 which permit these components to be detachably secured to each other. As shown in FIGS. 4 and 6, the hollow body member 2 includes a first annular lip 20 formed on the inner surface of the lower opening 8 thereof, while the bushing member 4 includes a second annular lip 22 formed on an outer surface of an upper portion thereof. The first and second annular lips 20, 22 securely engage each other when the bushing member 4 is fitted into the lower opening 8 of the body member 2. The first and second annular lips 20, 22 permit the bushing member 4 to be normally non-movably connected to the body member 2, but also permit the bushing member to be easily removed from the body member by having an operator simply insert a finger through the central opening 10 hooking the finger to engage an upper surface of the bushing member and pulling the bushing member 4 downwardly.

Additionally, the bushing member 4 may have a longitudinally-extending groove 24 formed in the outer surface thereof, while the hollow body member 2 may have a longitudinally-extending projection 26 formed on the inner surface of the lower end thereof which would engage the hollow groove 24 when the bushing member 4 is fitted in the body member 2. The groove and projection 24, 26 prevent the bushing member 4 from rotating about a central axis thereof when it is fitted in the body member 2. This feature is particularly important when the wand attachment 1 is used with a flashlight 6 that is turned on/of by rotating its upper end.

As shown in FIG. 6, the hollow body member 2 also includes a third annular lip 28 formed on the inner surface of the lower end thereof. This third annular lip 28 is positioned upwardly of the first annular lip 20 and functions as a stop for the bushing member 4.

Similarly, in reference to FIG. 7, the bushing member 4 includes a fourth annular lip 30 formed at the upper end of the central opening 10, which annular lip 30 functions as a stop for the upper end of the flashlight 6.

The overall construction of the present wand attachment, as discussed above, is very cost effective because it is constructed entirely of moldable polymeric materials. Also, the disclosed two-piece construction is very advantageous because the components can be quickly and easily assembled/disassembled without tools, and because only one component (the bushing member 4) is required to be changed to adapt the entire wand attachment 1 to different sized flashlights.

Although there has been described what is at present considered to be the preferred embodiment of the present invention, it will be understood that the invention can be embodied in other specific forms without departing from the spirit or essential characteristics thereof. For example, the body member 2 and the bushing member 4 could alternately have screw threads defined therein/thereon for connecting these components together, while the fingers 12 depending from the bushing member 4 could be formed as one continuous flange. The depicted embodiments are, therefore, to be considered in all aspects as illustrative, and not restrictive. The scope of the invention is indicated by the appended claims rather than the foregoing description.

I claim:

1. A wand attachment for flashlights, comprising:

a hollow, elongated body member having an opening formed at a lower end thereof; and a bushing member detachably fitted in said opening at the lower end of said body member;

said body member including a first annular lip formed on an inner surface of the lower end thereof and said bushing member includes a second annular lip formed on an outer surface thereof, said first and second annular lips securely engaging each other when said bushing member is fitted in said body member; and said bushing member having a central opening defined therein, said central opening being sized such that side surfaces thereof securely engage an upper, light-emanating end of a flashlight.

2. A wand attachment according to claim 1, wherein:

said body member has a third annular lip formed on said inner surface of the lower end thereof, said third annular lip being positioned upwardly of said first annular lip and functioning as a stop for said bushing member.

3. A wand attachment according to claim 1, wherein:

said bushing member includes a plurality of finger members depending downwardly from a lower surface thereof, said finger members being equiangularly spaces around said central opening and cooperating with said central opening to securely engage said upper end of said flashlight.

4. A wand attachment according to claim 3, wherein:

said bushing member includes a fourth annular lip formed at an upper end of said central opening, said fourth annular lip functioning as a stop for said upper end of said flashlight.

5. A wand attachment according to claim 1, wherein:

said bushing member further includes a longitudinally-extending groove defined in said outer surface thereof and said body member further includes a longitudinally-extending projection defined on said inner surface thereof, said longitudinally-extending projection engaging said longitudinally-extending groove to prevent said bushing member from rotating about a central axis thereof when said bushing member is fitted in said body member.

6. A wand attachment according to claim 1, wherein:

said body member and said bushing member are constructed entirely of a moldable, polymeric material, said polymeric material having a fluorescent pigment therein.

7. A wand attachment according to claim 1, wherein:

said body member has a longitudinal length which is at least as great as the longitudinal length of a handle portion of said flashlight so that said handle portion of said flashlight can be inserted into said hollow body member when said flashlight is not being used.

8. A wand attachment according to claim 7, wherein:

said hollow body member has another opening formed in an upper end thereof, said upper opening in said body member permitting a portion of light emitted from said flashlight to pass through said body member unobstructed.

9. A wand attachment according to claim 8, wherein:

said body member is conically shaped.

10. A wand attachment according to claim 1, wherein:

said wand attachment comprises a plurality of bushing members each having a differently sized central opening so that each can be used with a differently sized flashlight.

11. A warning/signaling device, comprising:

a flashlight having a handle and an upper, light-emanating end;

a hollow elongated body member having an opening at a lower end thereof; and a bushing member detachably fitted in said opening at the lower end of said body member;

said bushing member having a central opening defined therein and side surfaces of said central opening securely engaging said upper end of said flashlight;

said body member including a first annular lip formed on an inner surface of the lower end thereof and said bushing member including a second annular lip formed on an outer surface thereof, said first and annular second lips securely engaging each other when said bushing member is fitted in said body member.

12. A warning/signaling devices according to claim 11, wherein:

said body member and said bushing member are constructed entirely of a moldable polymeric material, said polymeric material having a fluorescent pigment therein

* * * * *

UNITED STATES PATENT AND TRADEMARK OFFICE

CERTIFICATE OF CORRECTION

PATENT NO. : 4,782,433

DATED : November 1, 1988

INVENTOR(S) : John G. Rombough

It is certified that error appears in the above-identified patent and that said Letters Patent is hereby corrected as shown below:

Column 1, line 51, change "into" to --in--.

Column 3, line 22, change "of" to --off--;

line 48, change "alternately" to --alternatively--.

Column 4, line 15 (claim 3, line 5), change "spaces" to --spaced--.

Column 5, line 7 (claim 11, line 16), change "annular second" to --second annular--.

Column 6, line 3 (claim 12, line 1), change "devices" to --device--;

line 8 (claim 12, line 6), insert a period after "therein".

Signed and Sealed this

Eighteenth Day of April, 1989

*Attest:*

DONALD J. QUIGG

*Attesting Officer*

*Commissioner of Patents and Trademarks*